US005915919A

United States Patent [19]

Taillant et al.

[11] Patent Number: 5,915,919

[45] Date of Patent: Jun. 29, 1999

[54] LAYOUT AND PROCESS FOR ADJUSTING THE DIAMETER OF A STATOR RING

[75] Inventors: Jean-Claude Taillant, Vaux le Pentil; Laurent Palmisano, Yerres; Marc Marchi, Le Mee; Patrick Rossi, Moissy Cramayel, all of France

[73] Assignee: Societe Nationale d'Etude et de Construction de Moteurs d'Aviation "Snecma", Paris, France

[21] Appl. No.: 08/893,521

[22] Filed: Jul. 11, 1997

[30] Foreign Application Priority Data

Jul. 25, 1996 [FR] France ..... 96 09364

[51] Int. Cl.[6] ..... F01D 11/24

[52] U.S. Cl. ..... 415/115; 415/173.2; 415/176; 415/178

[58] Field of Search ..... 415/115, 116, 415/117, 134, 136, 138, 173.1, 173.2, 175, 176, 177, 178; 60/516

[56] References Cited

U.S. PATENT DOCUMENTS

| | | | |
|---|---|---|---|
| 2,712,727 | 7/1955 | Morley et al. | 415/115 |
| 4,317,646 | 3/1982 | Steel et al. | 415/178 |
| 4,337,016 | 6/1982 | Chaplin . | |
| 5,064,343 | 11/1991 | Mills | 415/115 |
| 5,330,321 | 7/1994 | Roberts et al. | 415/177 |
| 5,593,277 | 1/1997 | Proctor et al. | 415/115 |

FOREIGN PATENT DOCUMENTS

| | | | |
|---|---|---|---|
| 0 115 984 | 8/1984 | European Pat. Off. . | |
| 2 295 239 | 7/1976 | France . | |
| 2 688 539 | 9/1981 | France . | |
| 6-173712 | 6/1994 | Japan | 415/178 |
| 2 062 117 | 5/1981 | United Kingdom . | |
| 2 217 788 | 11/1989 | United Kingdom . | |
| 2 263 138 | 7/1993 | United Kingdom . | |

*Primary Examiner*—Christopher Verdier
*Attorney, Agent, or Firm*—Oblon, Spivak, McClelland, Maier & Neustadt, P.C.

[57] ABSTRACT

Layout for adjusting the diameter of a turbine engine ring (5) positioned facing mobile rotor blades (4) and connected to a case element (7). The latter is provided with a cavity (16) communicating with chambers (21, 23) around a gas flow stream (31). A limited air current traverses the cavity (16) and is sufficiently reduced to ensure the development of a heat convection, which renders uniform the temperature of the case element (7) and the ring (5) and consequently the diameter of the latter.

12 Claims, 4 Drawing Sheets

LAYOUT AND PROCESS FOR ADJUSTING THE DIAMETER OF A STATOR RING

Figure 1:
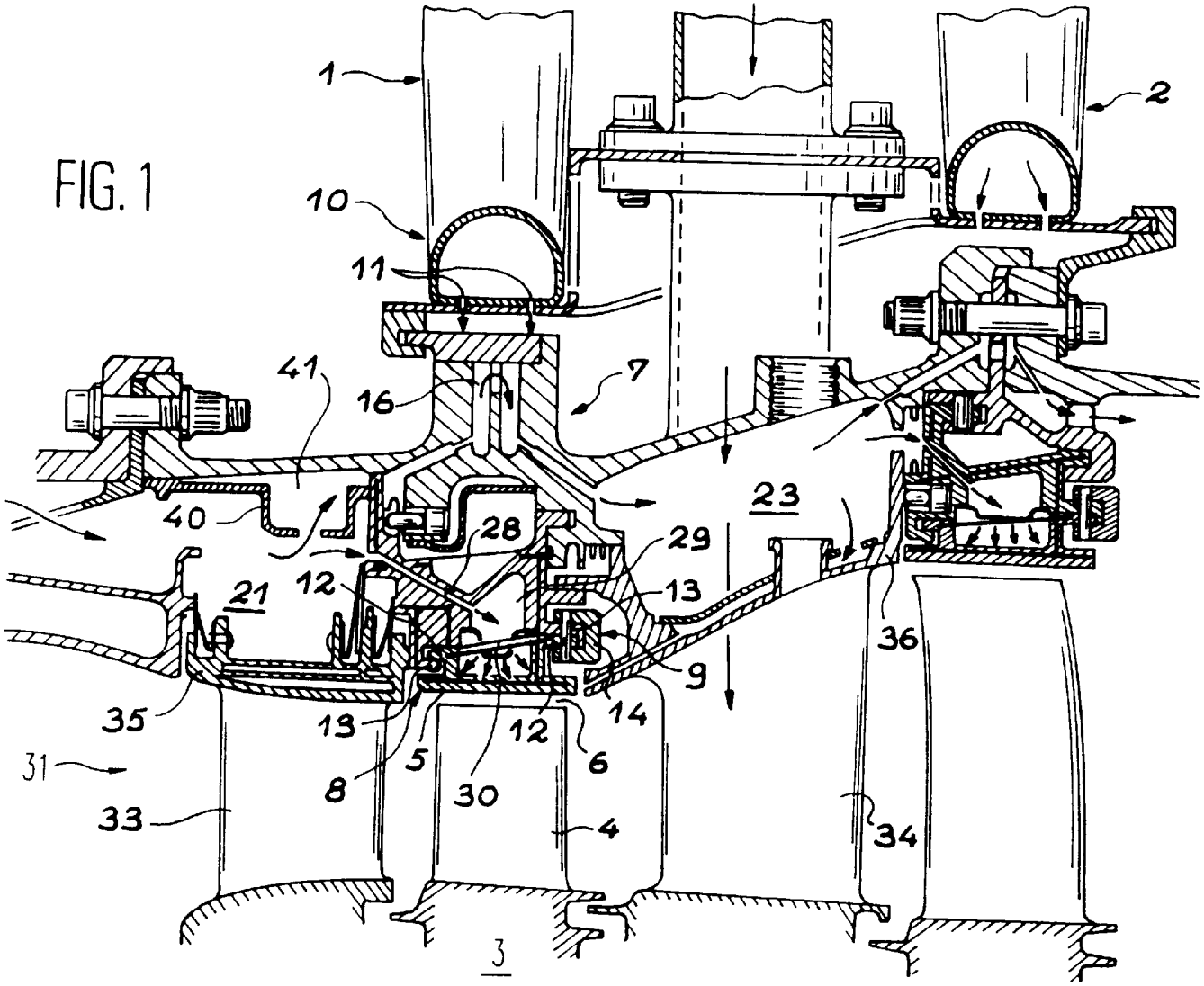

The invention relates to a layout and process for adjusting the diameter of a stator ring in order to reduce the clearance with rotor blade ends surrounded by said ring. Thus, it applies to turbine engines and has been mainly designed for a high pressure turbine in two-stage form, but without this application being exclusive.

The difficulty of obtaining a constant clearance between the rotors and stator rings surrounding them during the operation of the engine is due to variable mechanical expansions and contractions under the effect of speed and differential heating variations between the elements, particularly due to the difference of the thermal inertias. It is therefore necessary to accept larger clearances for certain operating conditions, which involves an efficiency loss.

In order to reduce such clearances, it has already been proposed to pass air at a variable pressure onto the turbine case in order to favour the expansion or contraction of the case supporting the stator ring. The air is taken from the compressor and its flow rate is regulated in response to a parameter of the engine e.g. indicating the temperature or speed. This air then penetrates ducts arranged coaxially around the turbine case and then escapes by numerous orifices and touches the case at impact points. However, it has been found that there is a homogeneity deficiency of the adjustment due to the discontinuous character, concentrated at a few points, of the air projection and deficiencies have also been observed in certain phases of flight where no impact occurs. Therefore the essential object of the invention is to propose a layout for adjusting the clearance between stator and rotor, whilst attenuating or avoiding the ovalization of the stator case, favouring the thermal homogenization thereof.

The adjustment layout according to the invention is characterized in that it comprises a hollowed out case element occupied by a cavity communicating by ducts with chambers located upstream and down-stream of the ring and which surround a gas circulation stream defined by the ring. This case element is connected to the ring and located between the ring facing the rotor and the surrounding gas blowing device.

As the chambers are relatively isolated from the stream, they are only traversed by small flows and the gas filling them is roughly stagnant in front of the locations where the ducts leading to the chambers issue, so that the flows within the cavity are essentially convective and thus favour the homogenization of the temperature of the case element under optimum conditions.

The process for the adjustment of the diameter of a stator ring linked with the inner periphery of the case element consists of, whilst blowing gas onto an external periphery of said element as before, producing an essentially convective gas flow through the case element, aside from the stator ring and between the external and internal peripheries.

The invention is described in greater detail hereinafter relative to non-limitative embodiments and the attached drawings, wherein show:

FIG. 1 A sectional view of the layout and surrounding parts of the turbine engine.

Figure 2:
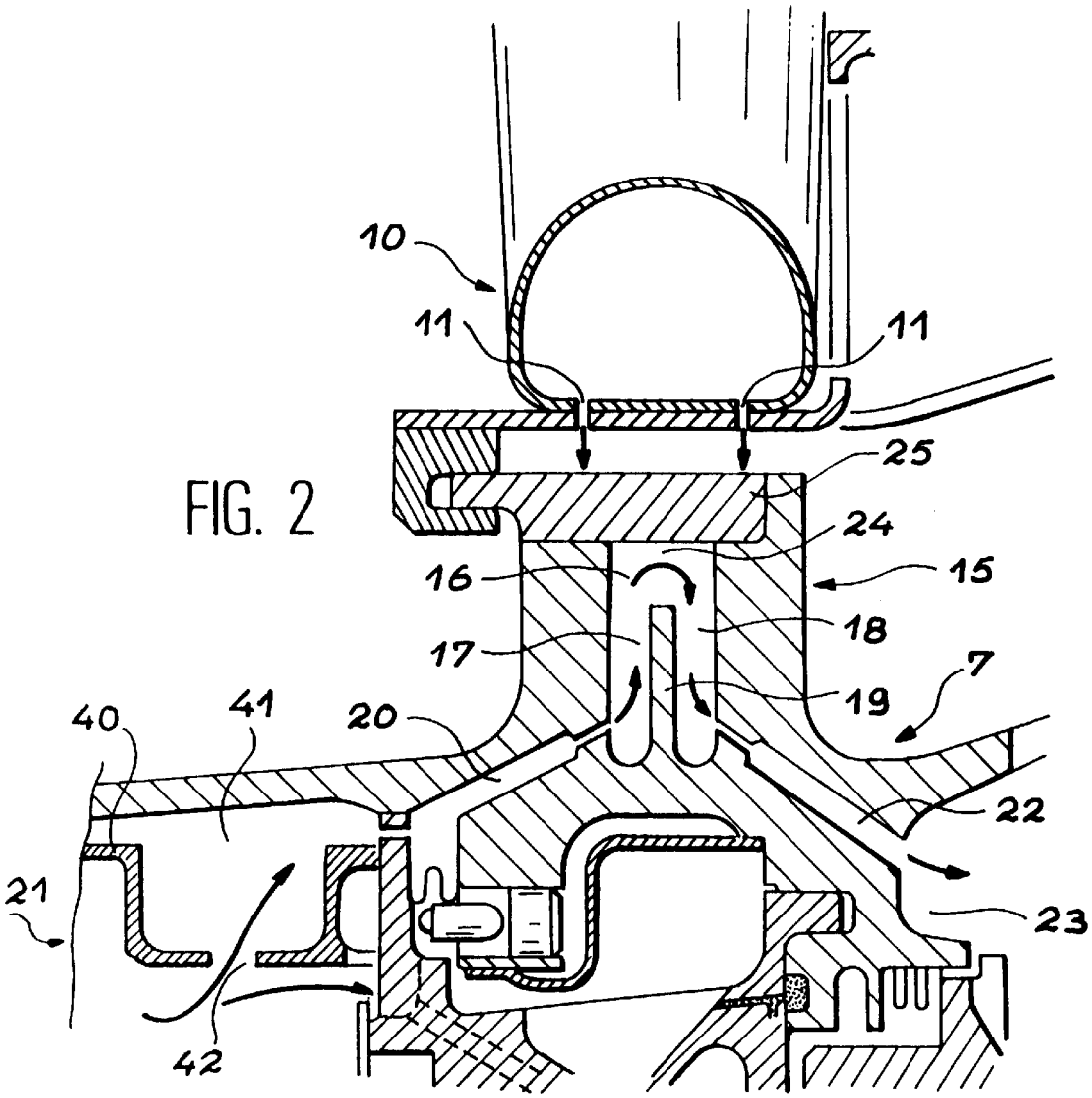

FIG. 2 A sectional view of the case element of the embodiment shown in FIG. 1.

Figure 3:
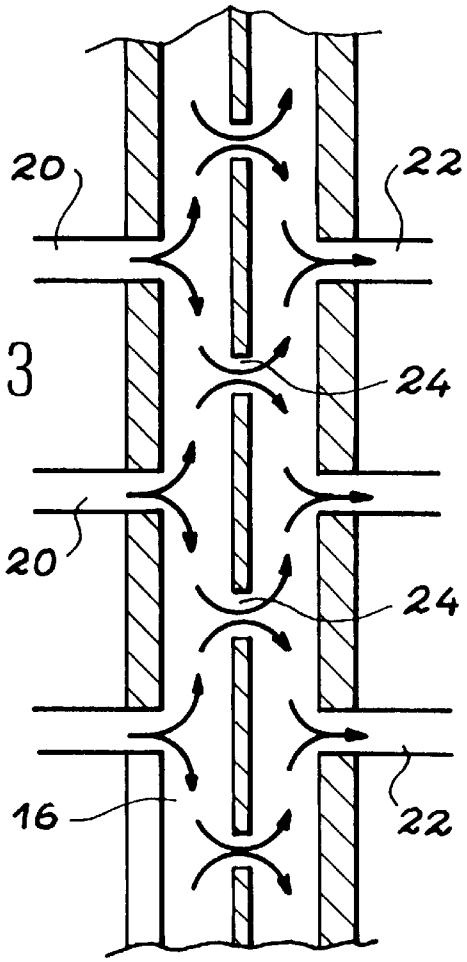

FIG. 3 A section of the case ring through the cavity.

Figure 4:
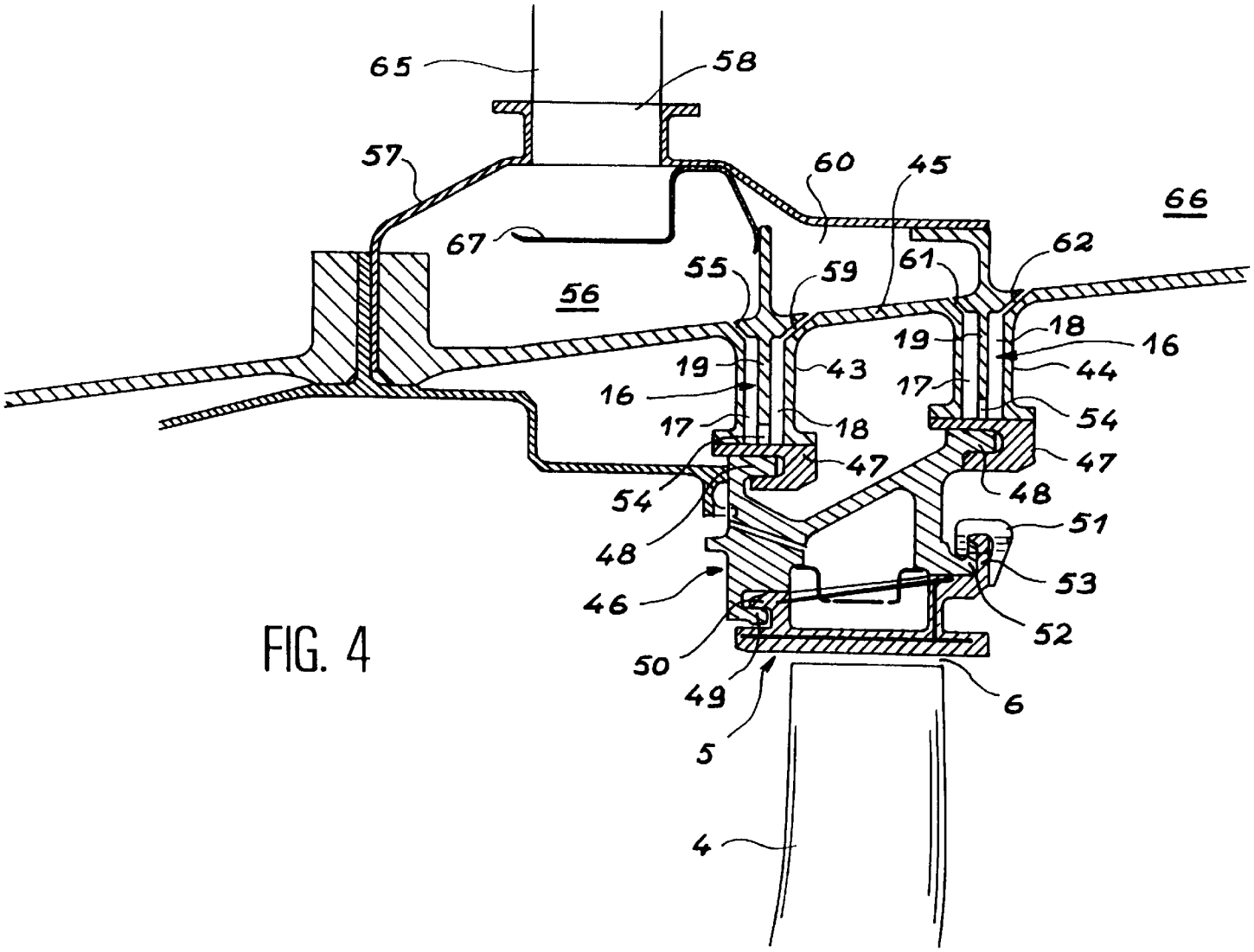

FIG. 4 a sectional view of a second embodiment of the present invention.

Figure 5:
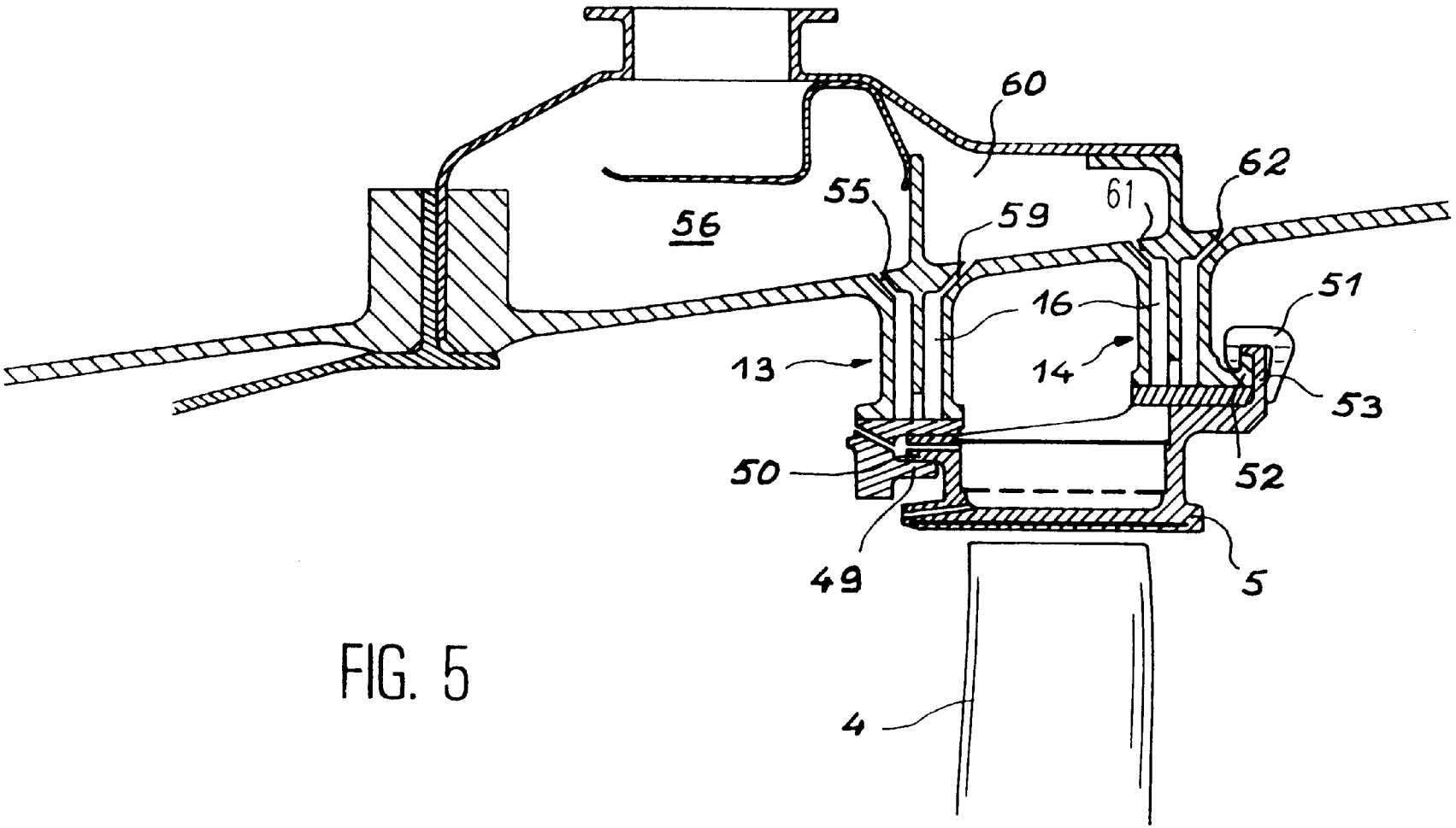

FIG. 5 a sectional view of a variant of the second embodiment of the present invention.

FIG. 1 shows a portion of a high pressure turbine with an upstream stage 1 and a downstream stage 2. Each of the stages 1 and 2 comprises, starting from a rotor 3 and towards the outside, a group of mobile blades 4 linked to the rotor 3, a ferrule 5 surrounding the mobile blades 5 and from which it is separated by a small clearance 6, a case element 7 to which the ferrule 5 is fixed by circular openings 8 and 9 on the upstream and downstream flanks, and the blowing distributor 10, which consists of a circular tube traversed by orifices 11 opening towards the case element 7 at a limited distance therefrom. The blowing distributor 10 is supplied with air by a not shown duct leading to the compressor. The openings 8 and 9 consist of circular members 12 and 13 of the ferrule 5 of the case element 7 between one another or between the lips of a circular joint with a U-shaped section 14. All these arrangements are known and do not form part of the present invention so that a detailed description will not be provided. Thus, the ferrule 5 constitutes the stator ring, whose diameter is to be adjusted to optimize the width of the clearance 6.

The essential element of the invention better visible in FIG. 2 is located on an outer portion 15 of the case element 7, which has a cavity 16 divided into two halves, an upstream groove 17 and a down-stream groove 18, by a transverse, planar, circular partition 19. Upstream ducts 20 leading to an upstream chamber 21 issue into the upstream groove 17 and downstream ducts 22 leading to a downstream chamber 23 issue into the downstream groove 18. The upstream 21 and downstream 23 chambers are located around bladed distributors 33, 34, each preceding mobile blade stages 4. Blade rings 35, 36 for supporting the blades of the distributors 33, 34 isolate the chambers 21, 23 from the gas circulation stream 31 in which the fixed and mobile blades extend, so that the air occupying the chambers 21 and 23 is only slightly agitated and remains virtually stagnant in their bottoms, where the ducts 20 and 22 issue. Reference is made in this connection to a cowling or fairing 40 isolating a chamber bottom 41 from the remainder of the chamber 21 and into which the upstream ducts 20 issue. The air current traversing the chamber 21 passes along the fairing 40 and can only pass through it by perforations 42 perpendicular to its flow in order to penetrate the chamber bottom 41. The flow towards the downstream direction through the cavity 16 and the ducts 20 and 22 is therefore at a low rate, which favours convection movements and thermal exchanges between said means, particularly in the cavity 16. Thus, the temperature of the case element 7 tends to even out without there being any significant air tapping.

The flow is further slowed down by the eccentric position of openings 24 in the partition 19 for linking the grooves 17 and 18. These openings 24 are in the form of lunules displaced axially and radially of the ducts 20, 22, which issue into the bottom of grooves 17 and 18. The openings 24 are located against the edge thereof close to the distributor 10 and from which they are only separated by a ferrule 25 integrated into the case element 7 and used for sealing the cavity 16 once it has been hollowed out. The air passes through the upstream groove 17 towards the outside and retraces its steps in the downstream groove 18 passing through the cavity 16. FIG. 3 also shows the openings 24 extending, in the angular direction in the cavity 16, midway of pairs of upstream 20 or downstream 22 ducts, which stirs up the air in the cavity 16. All these arrangements further increase convection.

Air coming from the upstream chamber 21 can also be tapped or sampled and directly directed to the turbine ring fairing 5 in order to adjust the diameter thereof in a direct manner.

It is also pointed out that there is another flow of the upstream chamber 21 through the case element 7 of the upstream turbine stage 1, along a channel 28 opening onto a chamber 29 closed by the ferrule 5. A perforated plate-like distributor 30 divides and evens out the air flow in front of the inner surface of the fairing 5. It is in fact a known system used jointly in the invention and which is only referred to here to better distinguish the latter. In particular, a relatively large gas flow is blown directly onto the ferrule 5.

Another important variant is shown in FIG. 4. The convection circuit is placed closer to the stator ring 5 and is subdivided into two elements, each of which is located in an annular rib 43 or 44 connecting an external case 45 to a spacer 46 carrying the stator ring 5. The ribs 43 and 44 are provided with members 47 engaged beneath retaining borders 48 of the spacer 46 in order to constitute said link and there is a member 49 on the spacer 46, engaged beneath a border 50 of the stator ring 5. All these borders 48 and 50 are retained in circular grooves designated by members 47 and 49. A staple 51 interconnects two circular flanges 52, 53 of the spacer 30 and the stator ring 5 in order to prevent an axial displacement of the latter.

The two elements of the convection circuit also have a cavity 16 subdivided into two parallel circular grooves 17, 18 by a partition 19. However, unlike in the preceding variant, the outwardly communicating ducts extend around cavities 16 and the openings (here 54) made through the partitions 19 are located on their internal circumferences in order to be radially displaced with respect to the ducts, as in the preceding variant. They can also be angularly displaced with respect to said ducts. The upstream ducts 55 of the cavity 16 in the rib 43 issue into the circular collecting chamber 56 essentially closed by a fairing 57 and which communicates with gas supply ducts 65 by the same number of perforations 58. The downstream ducts 59 of the cavity 16 issue into an intermediate chamber 60, into which also issue the upstream ducts 61 of the other cavity 16 located in the rib 14. The downstream ducts 62 of said other cavity 16 issue into another chamber 66. A deflecting fairing 67 is located in the chamber 56, in front of the issuing of the gas supply ducts 65, in order to inflect the flow thereof and make them progressively assume an angular direction. An upstream duct 55 is sheltered from the gas entry by the deflecting fairing 67 and is therefore located in a base of the chamber 56, where the gas is roughly stagnant. An advantage of this construction is linked with the presence of the cavities 16 in ribs 13 and 14, which are thicker and more rigid than the surrounding elements and close to the stator ring 5. This makes it possible to accurately and rapidly adjust the clearance 6 between the blades 4 and the stator ring 5. The gas blown by the orifices 58 and flowing along the circular collecting chamber 56 ensures that the stator ring 5 is brought to the desired average diameter and the circulation by convection of the gas through the cavities 16 renders uniform the diameter on the circumference. Moreover, the cavities 16 made in ribs 13, 14 necessary for supporting the stator ring 5, do not require the addition of a special element in the machine. Another economy results from the unity of the convection circuit for both cavities 16.

FIG. 5 shows the application of this system to a construction having no spacer 30. The aforementioned fixing elements 49 to 53 then directly connect the stator ring 5 to the ribs 13, 14. All the other arrangements of FIG. 4 are unchanged.

We claim:

1. A layout for adjusting a diameter of a stator ring by means of a surrounding, gas blowing device comprising:

a hollowed out case element, linked with the ring and located between the ring and the gas blowing device, said hollowed out case element occupied by a cavity placed on a stator ring support rib, communicating by ducts with chambers upstream and downstream from the ring and surrounding a gas circulation stream defined by the ring and occupied by gas in front of the ducts, the cavity and ducts extending aside from the stator ring;

wherein two of said cavity are placed in two parallel, stator ring support ribs the cavities communicating with one another by ducts and an intermediate chamber.

2. A stator ring diameter adjustment layout according to claim 1, wherein the cavity is subdivided by a perforated partition into an upstream half into which issue the ducts communicating with the upstream chamber and a downstream half into which issue the ducts communicating with the downstream chamber.

3. A stator ring diameter adjustment layout according to claim 2, wherein the partition has openings displaced radially of the ducts.

4. A stator ring diameter adjustment layout according to claim 2, wherein the partition is provided with openings displaced angularly of the ducts.

5. A stator ring diameter adjustment arrangement according to claim 1, wherein one of the chambers is part of a circuit for blowing gas onto the stator ring.

6. A stator ring diameter adjustment layout according to claim 1, wherein one of the chambers is part of the surrounding blowing device.

7. A layout for adjusting a diameter of a stator ring by means of a surrounding, gas blowing device comprising:

a hollowed out case element, linked with the ring and located between the ring and the gas blowing device, said hollowed out case element occupied by a cavity communicating by ducts with chambers upstream and downstream from the ring and surrounding a gas circulation stream defined by the ring and occupied by gas in front of the ducts, the cavity and ducts extending aside from the stator ring;

wherein one of the chambers is the a seat of a gas flow and in that a fairing located in the chamber defines therein a chamber base in which flow is restricted and into which issue the ducts of the cavity communicating with said chamber.

8. A stator ring diameter adjustment layout according to claim 7, wherein the cavity is subdivided by a perforated partition into an upstream half into which issue the ducts communicating with the upstream chamber and a downstream half into which issue the ducts communicating with the downstream chamber.

9. A stator ring diameter adjustment layout according to claim 8, wherein the partition has openings displaced radially of the ducts.

10. A stator ring diameter adjustment layout according to claim 8, wherein the partition is provided with openings displaced angularly of the ducts.

11. A stator ring diameter adjustment arrangement according to claim 7, wherein one of the chambers is part of a circuit for blowing gas onto the stator ring.

12. A stator ring diameter adjustment layout according to claim 7, wherein one of the chambers is part of the surrounding blowing device.

* * * * *